United States Patent [19]

Logan

[11] Patent Number: 4,928,982

[45] Date of Patent: May 29, 1990

[54] CONVERTIBLE RUNNING SHOES/ROLLER SKATES

[76] Inventor: Kenneth C. Logan, P.O. Box 48168 Bentall Centre, Vancouver, B.C., Canada, V7X 1N8

[21] Appl. No.: 170,002

[22] Filed: Mar. 18, 1988

[51] Int. Cl.[5] ..... A63C 17/14

[52] U.S. Cl. ..... 280/11.22; 36/115; 36/15; 280/11.31

[58] Field of Search ..... 280/11.19, 11.22, 11.23, 280/11.25, 11.27, 11.3, 11.31; 36/115, 15

[56] References Cited

U.S. PATENT DOCUMENTS 1,975,661 10/1934 Powell ..... 280/11.25
2,422,228 6/1947 Ferrar ..... 280/11.19
3,351,353 11/1967 Weitzner ..... 280/11.22 X
3,983,643 10/1976 Schreyer et al. ..... 36/115

FOREIGN PATENT DOCUMENTS 821323 11/1951 Fed. Rep. of Germany ... 280/11.19
24729 of 1915 United Kingdom ..... 280/11.23

*Primary Examiner*—Charles A. Marmor
*Assistant Examiner*—Michael Mar

[57] ABSTRACT

The present invention relates to a set of disks rotatably attached to a sole plate or plates or other footwear to effect a roller skate mode, such disks to be capable of retraction or removal to effect a walk/run mode.

2 Claims, 8 Drawing Sheets

CONVERTIBLE RUNNING SHOES/ROLLER SKATES

The present invention relates to a set of discs rotatably attached to a sole plate or plates or other footwear to effect a roller skate mode, such discs to be capable of retraction or removal to effect a walk/run mode.

There are occasions when it would be advantageous to convert a pair of walking or running shoes into a pair of roller skates without the need of carrying bulky wheels or other paraphenalia. Furthermore, the restricted diameter of conventional roller skate wheels are subject to adverse hang-up in large sidewalk cracks etc. therefore, a new roller design that would produce the effect of a larger diameter wheel would be advantageous.

Heretofore, a number of attempts have been made to convert shoes to roller skates however, the results have produced either relatively inefficient skates or have resulted in a rather bulk wheel retraction configuration making walking or running somewhat awkward.

In order to overcome these inadequacies, the present invention provides a unique canted set of discs capable of compact retraction while at the same time providing a rolling surface that is capable of effective operation on much rougher surfaces or terrain than can be effectively negotiated by conventional roller skate or skate board wheels.

Accordingly, it is an object of the present invention to provide a canted disc system that can be retracted for running or walking or that can be detached and easily replaced with a flexible sole for running or walking. It is another object of the present invention to illustrate a series of possible retraction configurations. It is still a further object of the present invention to describe various disc configurations.

In the specification and the accompanying drawings, some preferred embodiments of the present invention in a set of convertible shoe/roller skates are shown and described. It is to be understood that these disclosed embodiments are not intended to be exhaustive nor a limitation of the invention, but, on the contrary, they are shown for the purpose of illustration in order that others skilled in the art may fully understand the invention, its principles and the manner of carrying it out.

Figure 1:
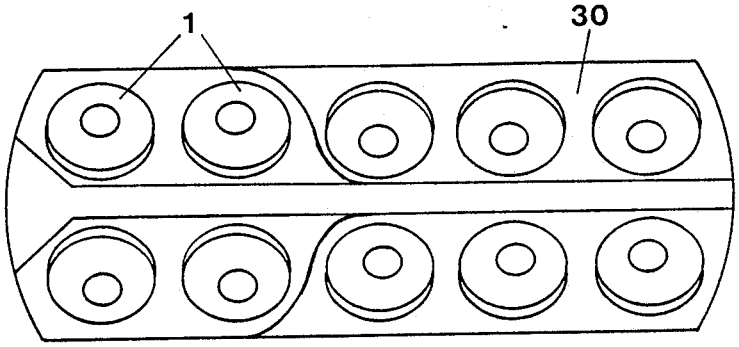
FIG. 1 is a plan view of the underside of a non-retractable disc plate.
Figure 2:
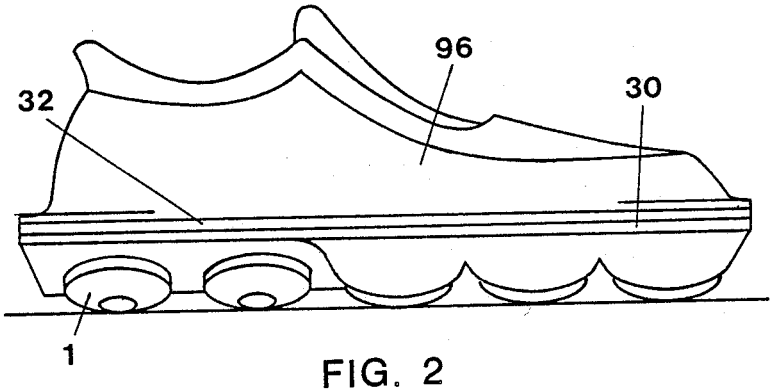
FIG. 2 is a side elevation of a non-retractable disc plate.
Figure 3:
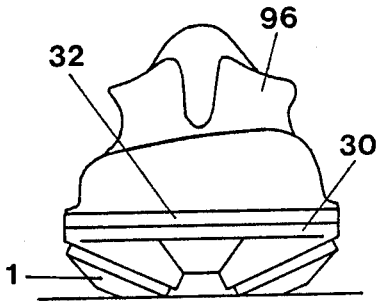
FIG. 3 is a front elevation of a non-retractable disc plate showing the discs canted outward.
Figure 4:
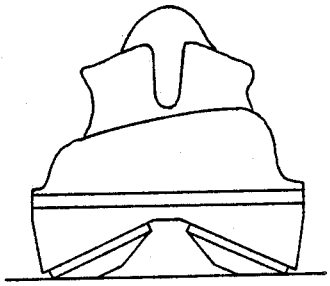
FIG. 4 is a front elevation of a non-retractable disc plate showing the discs canted inward.

Referring to the drawings, and to FIGS. 1 through 4 in particular, a set of conical disks rotatably mounted on a running shoe sole is shown. The system is comprised of a set of truncated conical disks 1 rotatably attached at an angle to a fixed disk plate 30 which is in turn affixed to a fixed plate sole 32. This configuration represents the simplest version of the present invention.

Figure 7:
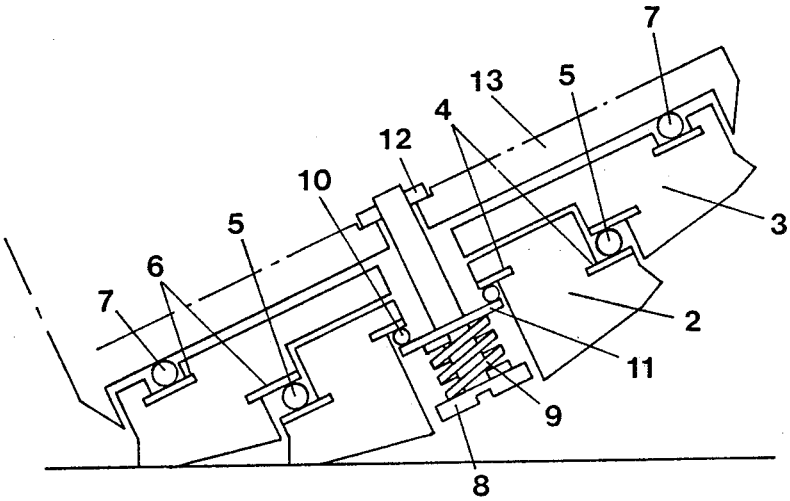
FIG. 7 is a schematic representation of a co-axial compound disk.
Figure 8:
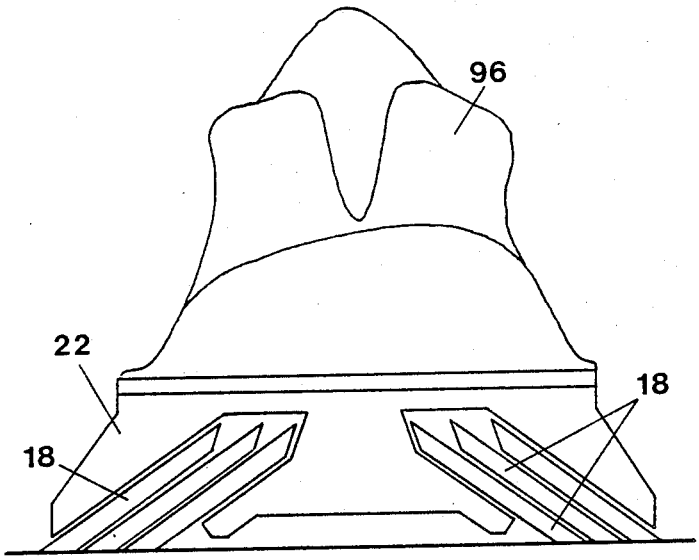
FIG. 8 is a front elevation showing the orientation of a set of sliced disks.
Figure 9:
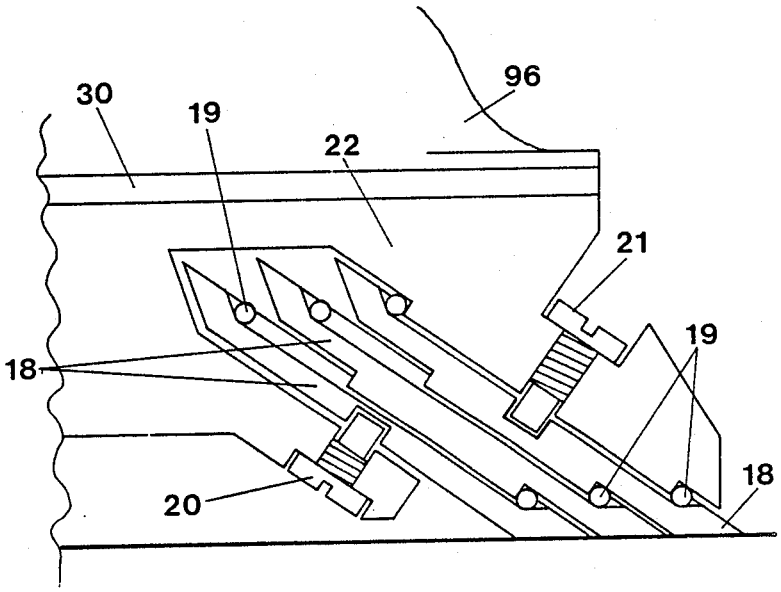
FIG. 9 is a detail of one of the sliced disk modules.
Figure 10:
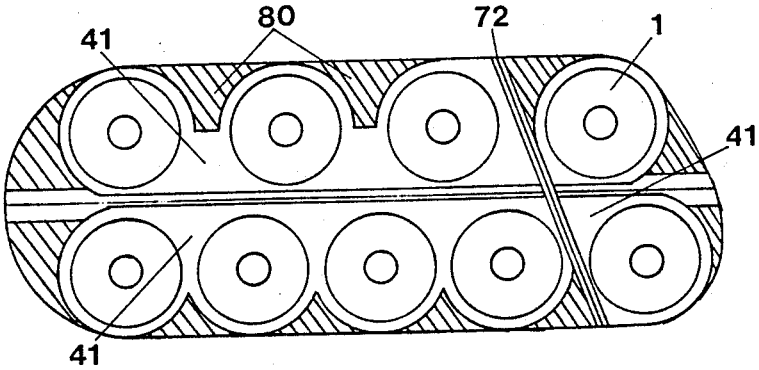
FIG. 10 is a plan view of the underside of a retractable disk plate.
Figure 11:
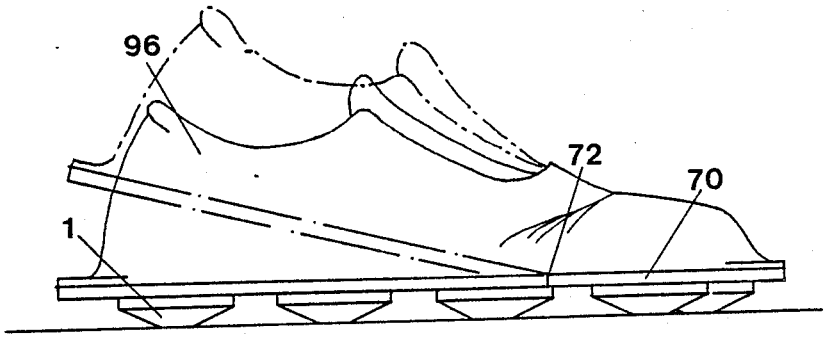
FIG. 11 is a side elevation of a retractable disk plate.
Figure 12:
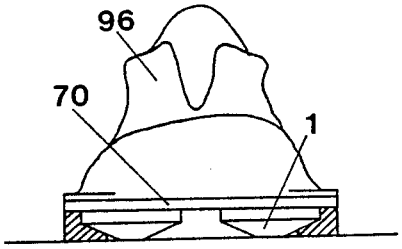
FIG. 12 is a front elevation of a retractable disk plate showing the disks retracted.

FIGS. 7, 8 and 9 depict variations on the conical disks 1. FIG. 7 depicts two co-axial disks, inner co-axial disk 2 and outer co-axial disk 3. The inner co-axial disk 2 is rotatably supported by inner co-axial disk bearing plates 4 and the inner co-axial disk bearings 5. The outer co-axial disk 3 is rotatably supported by outer co-axial disk bearing plates 6 and the outer co-axial disk bearings 7. Both inner co-axial disk 2 and outer co-axial disk 3 are held in place by a retention bolt 8 with a retention bolt spring 9 pressing a retention bolt bearing plate 11 and a retention bolt bearing 10 against an inner co-axial disk bearing plate 4. The retention bolt 8 is inserted in a slotted hole in the disk plate 13 and turned 90 degrees so that the retention bolt pin 12 retains the retention bolt 8 in place.

FIGS. 8 and 9 depict a unique multi-disk configuration. Sliced disks 18 are rotatably supported by sliced disk bearings 19. The disks are held in place by a lower centering bolt 20 and an upper centering bolt 21 which are in turn threaded into the disk housing 22 which is attached to the fixed sole plate 30 which has attached to it a shoe or other footwear upper 96.

The disk configurations depicted in FIGS. 7, 8 and 9 can be assumed to be synonomous with the term conical disks 1 used in the remainder of this specification.

Figure 5:
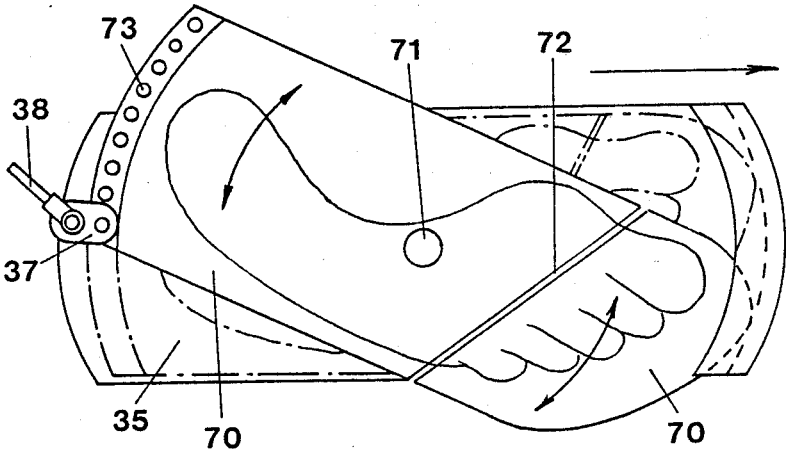
FIG. 5 is a plan view of a clamp-on disc/tread receiving sole plate.
Figure 6:
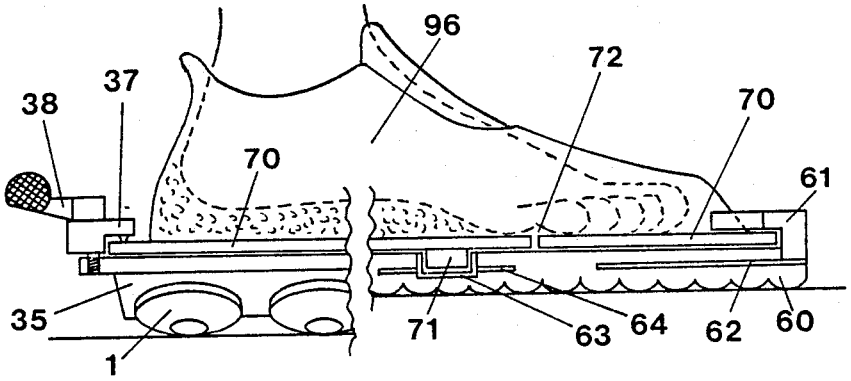
FIG. 6 is a side elevation of a clamp-on disk/tread receiving sole plate with the rear of the shoe depicting the disc plate and the front of the shoe depicting the flexible tread.

FIGS. 5 and 6 depict an embodiment of the system wherein FIG. 6 depicts a hybrid side elevation wherein the rear of the shoe upper 96 is supported by a clamp-on disk plate 35 to which are attached conical disks 1 and the front of the shoe upper 96 is supported by the front portion of a removeable tread 60 comprised of a toe retention channel 61, a perforated channel anchor plate 62, rotation pin seat 63 and a rotation pin seat perforated anchor plate 64. The aforementioned anchor plates are perforated to permit the rubber or synthetic material of which the removeable tread 60 is comprised to flow through the perforations and thus bond the metal anchors into the tread material.

FIG. 6 shows the rear of the clamp on disk plate 35 afixed to the hinged sole plate 70 by a plate/tread alignment bracket 37 and a plate/tread alignment bracket lever screw 38. In the actual embodiment, the clamp on disk plate 35 extends to the front of the shoe and has a channel similar to the toe retention channel 61. Conversely, in the actual embodiment, the removeable tread 60 extends to the rear of the shoe and has a perforated anchor plate containing alignment holes 73. In addition to being replaced by a disk plate 35, the removeable tread 60 can be replaced by new removeable treads when worn or when different tread patterns are desired. The clamp on disk plate or removeable tread 60 are free to rotate about a rotation pin 71. A sole plate toe joint hinge 72 is provided to allow the shoe or other footwear upper 96 to flex along the toe joint line while in the walk/run configuration.

Figure 13:
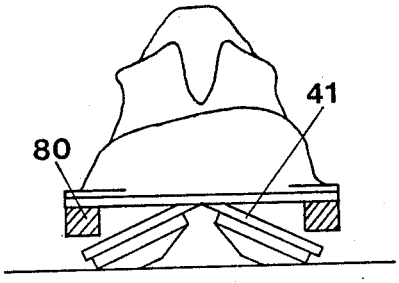
FIG. 13 is a front elevation of a retractable disk plate showing the disks extended.
Figure 14:
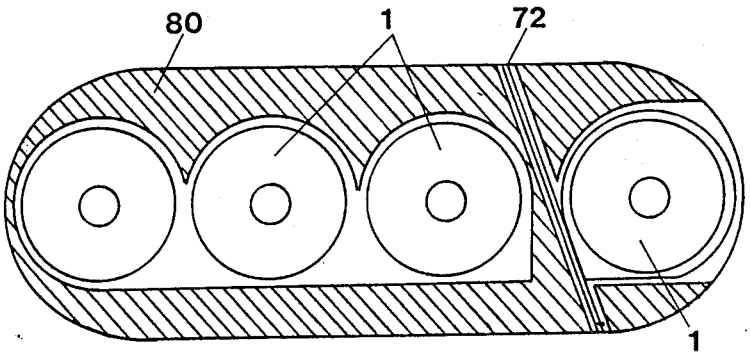
FIG. 14 is a plan view of the underside of a retractable disk plate.
Figure 15:
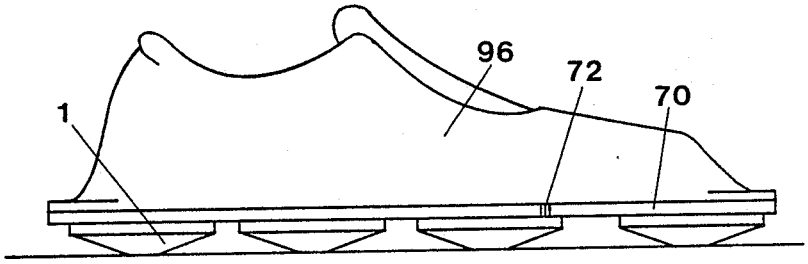
FIG. 15 is a side elevation of a retractable disk plate.
Figure 16:
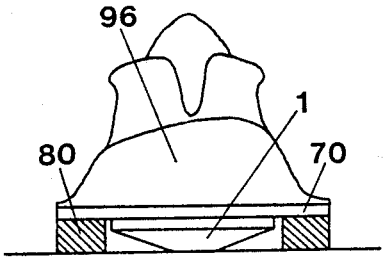
FIG. 16 is a front elevation of a retractable disk plate showing the disks retracted.
Figure 17:
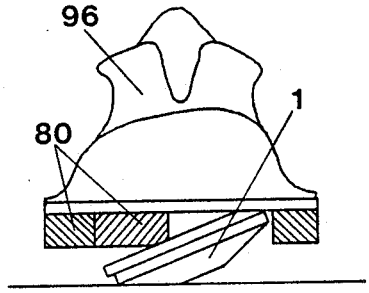
FIG. 17 is a front elevation of a retractable disk plate showing the disks extended.

FIGS. 10, 11, 12 and 13 depict a configuration wherein the conical disks 1 can be retracted to permit walking or running. In FIG. 13, the hinged disk plates 41 are shown in the extended or roller configuration whereas in FIG. 12 the hinged disk plates 41 are shown retracted up into the hinged sole plate 70 to provide a walk/run mode. When the system is in the walk/run mode, the hinged disk plate sole treads 80 are in contact with the sidewalk or other running/walking surface.

FIGS. 14, 15, 16 and 17 depict another retractable system wherein a single row of conical disks 1 provide the roller mode.

Figure 18:
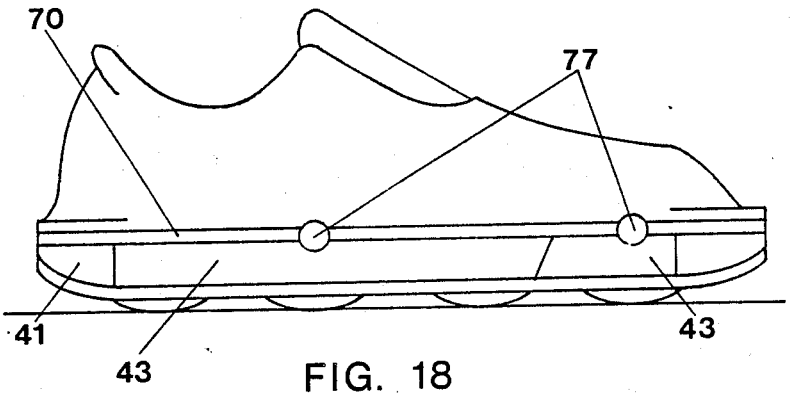
FIG. 18 is a side elevation of a retractable disk plate showing the lock-down mechanism.
Figure 19:
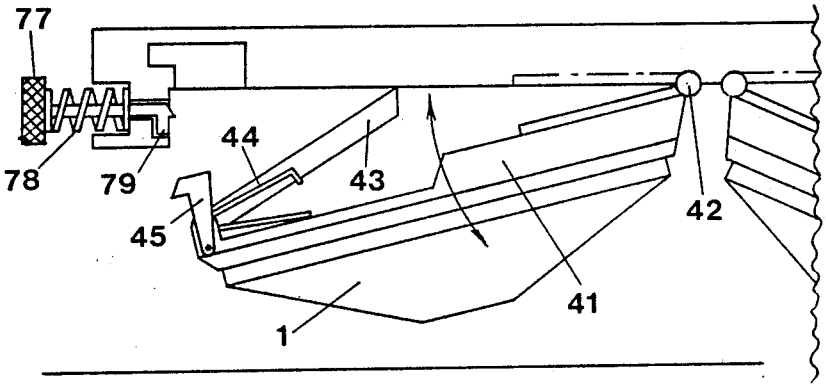
FIG. 19 is a detail of the lock-up/lock-down mechanism with the disk shown partially extended.
Figure 20:
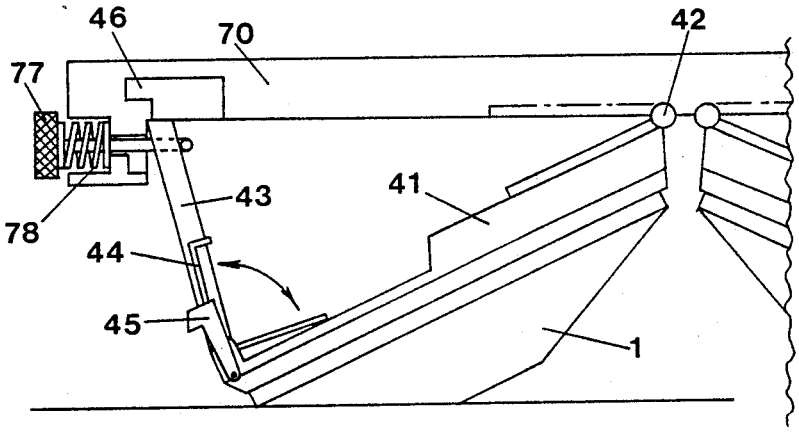
FIG. 20 is a detail of the lock-up/lock-down mechanism with the disk shown fully extended.
Figure 21:
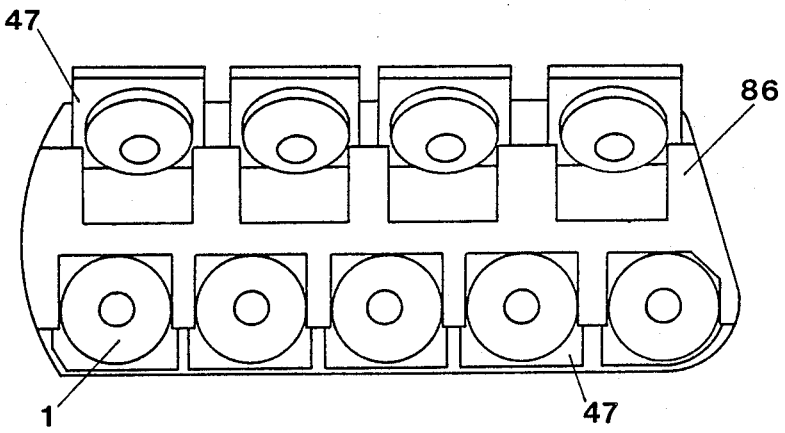
FIG. 21 is a plan view of the underside of a roll-out retractable disk plate.

FIGS. 18, 19 and 20 depict one preferred embodiment of a latching mechanism for a retractable disk system. FIG. 19 shows a hinged disk plate 41 partially extended. As the hinged disk plate 41 rotates about disk plate hinge 42, the hold down brace 43 jack knives open propelled by the hold down brace spring 44. As the hinged disk plate 41 reaches full extension as in FIG. 20, the hold down brace 43 is fully open at which point, the holding pin 77 is pressed through a knotch in the hold down brace 43 and turned 90 degrees. The compression of the holding pin spring 78 causes the hold down brace to thus be held in place.

To retract the disk plate, the holding pin 77 is turned 90 degrees causing it to pop out of the slot in the hold down brace 43. The hold down brace 43 is depressed inward while the hinged disk plate 41 is pulled upward until the hold up clip 45 becomes engaged in the hold up clip notch 46.

FIGS. 21, 22, 23 and 24 depict a retractable disk system featuring an out-roll type of extension providing a wider support base in the roller configuration. In this configuration, each out-roll disk plate 47 has a curved upper surface that can rotate within the rotation cavities of the outroll cavity plate 85. The out-roll cavity plate 85 is in turn attached to an out-roll disk plate sole 84. The out-roll disk plates 47 are held in place by the disk retention plate 86.

Figure 22:
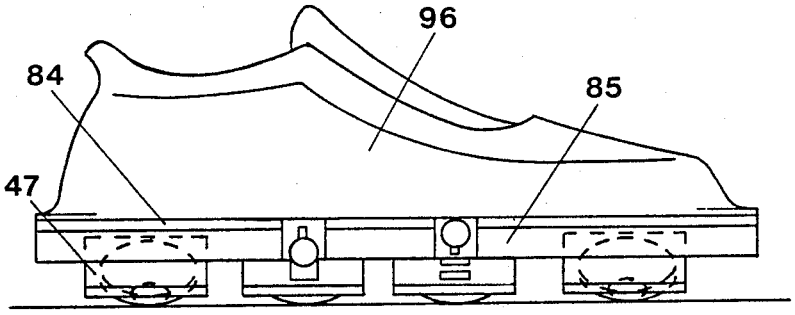
FIG. 22 is a side elevation of a roll-out retractable disk plate.
Figure 23:
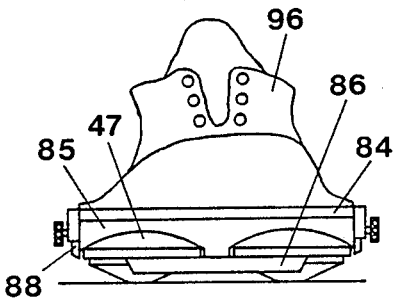
FIG. 23 is a front elevation of a roll-out retractable disk plate showing the disks retracted.
Figure 24:
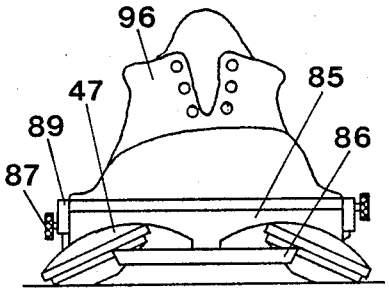
FIG. 24 is a front elevation of a roll-out retractable disk plate showing the disks extended.
Figure 25:
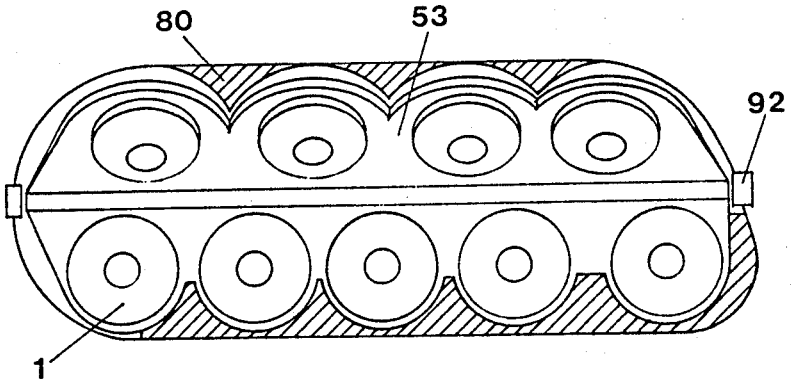
FIG. 25 is a plan view of the underside of a wedged retractable disk plate.
Figure 26:
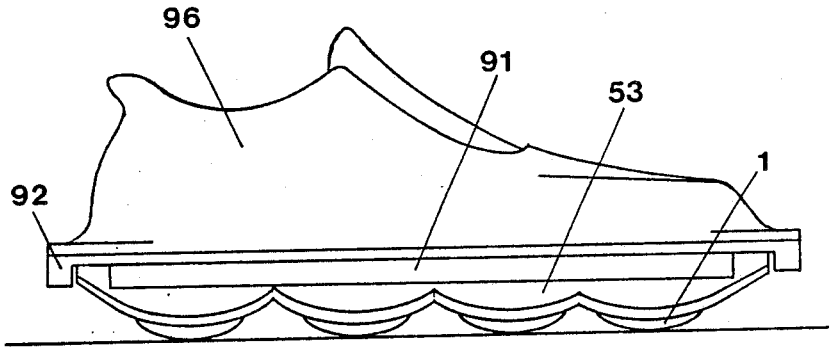
FIG. 26 is a side elevation of a wedged retractable disk plate.
Figure 27:
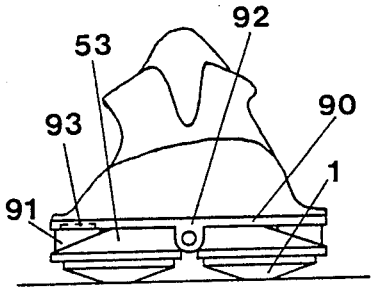
FIG. 27 is a front elevation of a wedged retractable disk plate showing the disks retracted and FIG. 28 is a front elevation of a wedged retractable disk plate showing the disks extended.
Figure 28:
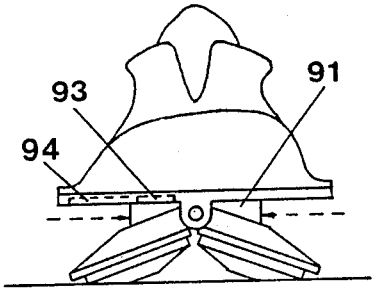

FIGS. 22, 23 and 24 show disk positioning latches 87, disk positioning latch bolts 88 and disk positioning latch guideways 89. In an actual embodiment, each out-roll disk plate 47 would have an independent disk positioning latch 87.

FIGS. 25, 26, 27 and 28 depict a retractable disk system featuring a sliding wedge type of extension device. In this configuration, sliding wedges 91 slide inward causing the wedged disk plates 53 to rotate about the sole plate hinge 92 which is which is integral with the wedged disk plate sole 90, into an extended configuration. The sliding wedges 91 feature wedge guides 93 that slide in wedge guide tracks 94.

A.lthough not detailed herein, the sliding wedge system would also incorporate a latch system similar to that described in FIGS. 22, 23 and 24 for the out-roll disk system.

While the present illustrated embodiments are for the purpose of setting forth illustrative examples of the present invention, it is to be understood that others will occur to those skilled in the art which are within the scope and spirit of the following claims.

I claim:

1. A convertible roller skate comprising: footwear including a sole plate having a heel portion, a toe portion hinged to the heel portion for permitting normal flexure of the sole plate during walking or running by a user, and a pivot pin extending downwardly from said heel portion at a central portion of said sole plate;

a disk plate including a toe retention channel for receiving the toe portion of said sole plate, a pivot pin seat for rotatably receiving said pivot pin, means for removably locking said sole plate to said disk plate at selected angles of rotation about said pivot pin, and a plurality of truncated conical disks rotatably attached to the lower surface of said disk plate along two longitudinally extending rows, each row of disks comprising a plurality of front disks having an axis of rotation extending inwardly and downwardly with respect to a vertical plane intersecting the center line of said disk plate and a plurality of rear disks having an axis of rotation extending inwardly and upwardly with respect to said vertical plane; and a flexible tread plate including means for removably securing said tread plate to said sole plate, wherein said tread plate may be secured to the sole plate of said footwear for use as a conventional shoe or said disk plate may be secured to the sole plate of said footwear for use as a roller skate.

2. A convertible roller skate as set forth in claim 1, wherein said means for locking said sole plate to said disk plate comprises a vertically adjustable bracket mounted at the rear end of said disk plate, said bracket having a depending portion, and a plurality of holes along the rear end of said heel portion for receiving said depending portion in a selected one of said holes.

* * * * *